US005398180A

United States Patent [19]

Lee

[11] Patent Number: 5,398,180

[45] Date of Patent: Mar. 14, 1995

[54] LOW VOLTAGE LIGHT FIXTURE

[76] Inventor: James Lee, 5th Fl., No. 10, Alley 10, Lane 321, Hsin Ming Rd., Nei Hu Dist., Taipei, Taiwan, Prov. of China

[21] Appl. No.: 168,164

[22] Filed: Dec. 17, 1993

[51] Int. Cl.[6] ..... F21S 1/10; H01R 4/24

[52] U.S. Cl. ..... 362/431; 362/152; 362/391; 439/414; 439/419

[58] Field of Search ..... 362/152, 153.1, 153, 362/145, 391, 427, 431, 300; 439/414, 419, 619, 699; 248/533, 156, 299; 403/61, 113, 116

[56] References Cited

U.S. PATENT DOCUMENTS

| | | | |
|---|---|---|---|
| 518,988 | 5/1894 | Fisher | 403/116 |
| 4,774,648 | 9/1988 | Kakuk | 362/431 |
| 4,826,448 | 5/1989 | Maddock | 439/414 |
| 4,870,548 | 9/1989 | Beachy et al. | 362/431 |
| 4,996,636 | 2/1991 | Lovett | 362/431 |
| 5,008,588 | 4/1991 | Nakahara | 439/699 |
| 5,055,987 | 10/1991 | Ellson et al. | 362/431 |
| 5,141,449 | 8/1992 | Tieszen | 439/419 |

*Primary Examiner*—Stephen F. Husar
*Assistant Examiner*—Sara Sachie Raab
*Attorney, Agent, or Firm*—Nikaido, Marmelstein, Murray & Oram

[57] ABSTRACT

A temple light including (a) a lens with a cylindrical configuration with an opening formed in a first end and a bottom formed at a lower end, (b) a bulb receiver projecting upward from the bottom of the lens, (c) a connector being mounted in the bulb receiver and defining two chambers, (d) two bulb lead contacts each including an upper section including two leaf springs and a lower section, the upper section of each bulb lead contacts being received in a corresponding chamber defined in the bulb receiver with the leaf springs holding a corresponding one of two bulb leads projecting from a bulb, (e) a connector being received in the bulb receiver and defining two chambers each receiving the lower section of a corresponding bulb lead contact, (f) two replaceable cable-piercing contacts each including a tubular upper section and a sharp lower section, the lower section of a bulb lead contact being received in the tubular upper section of a corresponding cable-piercing contact being received in a corresponding chamber defined in the connector and (g) a post/stake element including a post and a stake projecting downward from the post, the post being linked to the bottom of the lens.

2 Claims, 6 Drawing Sheets

LOW VOLTAGE LIGHT FIXTURE

BACKGROUND OF INVENTION

The present invention relates to a low voltage light fixture and, particularly, to a device employed by such a low voltage light for connecting a bulb with two cables.

U.S. Pat. No. 4,774,648, is believed to be the most pertinent prior art. U.S. Pat. No. 4,774,648 teaches a temple light employing a post/stake assembly, a unique internally ribbed lens and a pair of integral contact/-prong elements. The post/stake assembly is made from a single piece of plastic, and consists of two legs each of which is joined by means of a "living hinge" to a female adapter. The legs mate with each other so as to form a configuration which includes a hollow tubular post portion and a cruciform stake portion. The lens has a plurality of internal side ridges and a number of top ridges.

Each "living hinge" forms a weak point which can be easily broken. Furthermore, the legs might depart from each other during the insertion thereof into the earth, thus obstructing the insertion thereof into the earth. Moreover, the integral contact/prong element might not achieve the minimum cost as a new integral contact/prong element must be substituted for an old integral contact/prong element even if only the prong portion thereof is damaged.

Therefore, the present invention is intended to solve the above-mentioned problems.

SUMMARY OF INVENTION

The primary object of the present invention is to provide a low voltage light fixture which has a lens which has an open upper end and a closed lower end on which two sleeves are formed in order to each receive a corresponding bulb receiving element.

DETAILED DESCRIPTION OF PREFERRED EMBODIMENT

Figure 1:
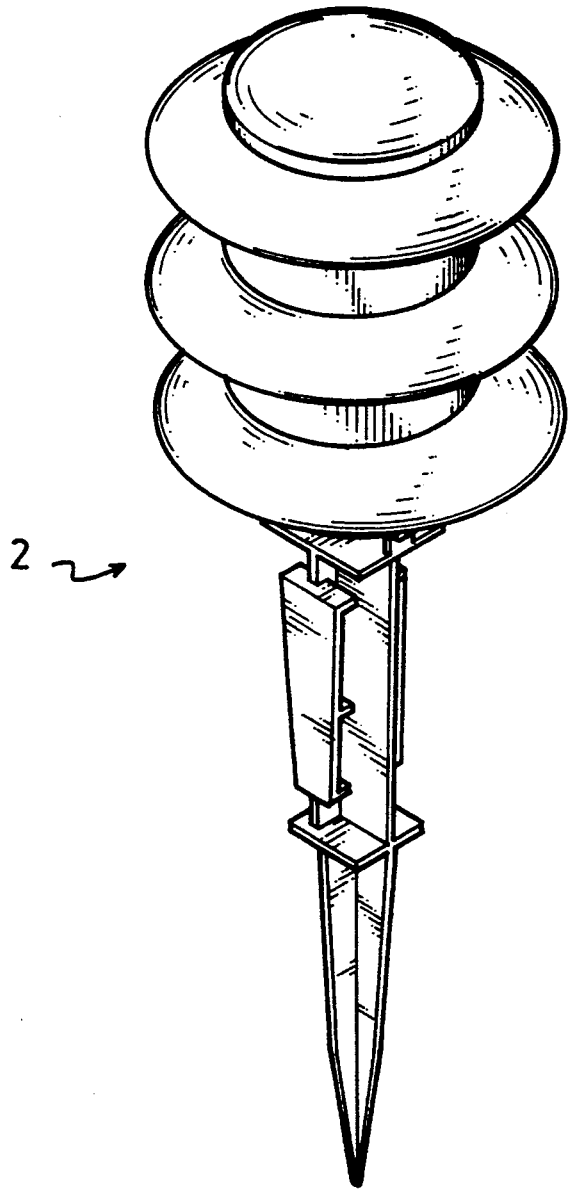
FIG. 1 is a perspective view of a temple light fixture in accordance with the preferred embodiment of the present invention.
Figures 2, 3:
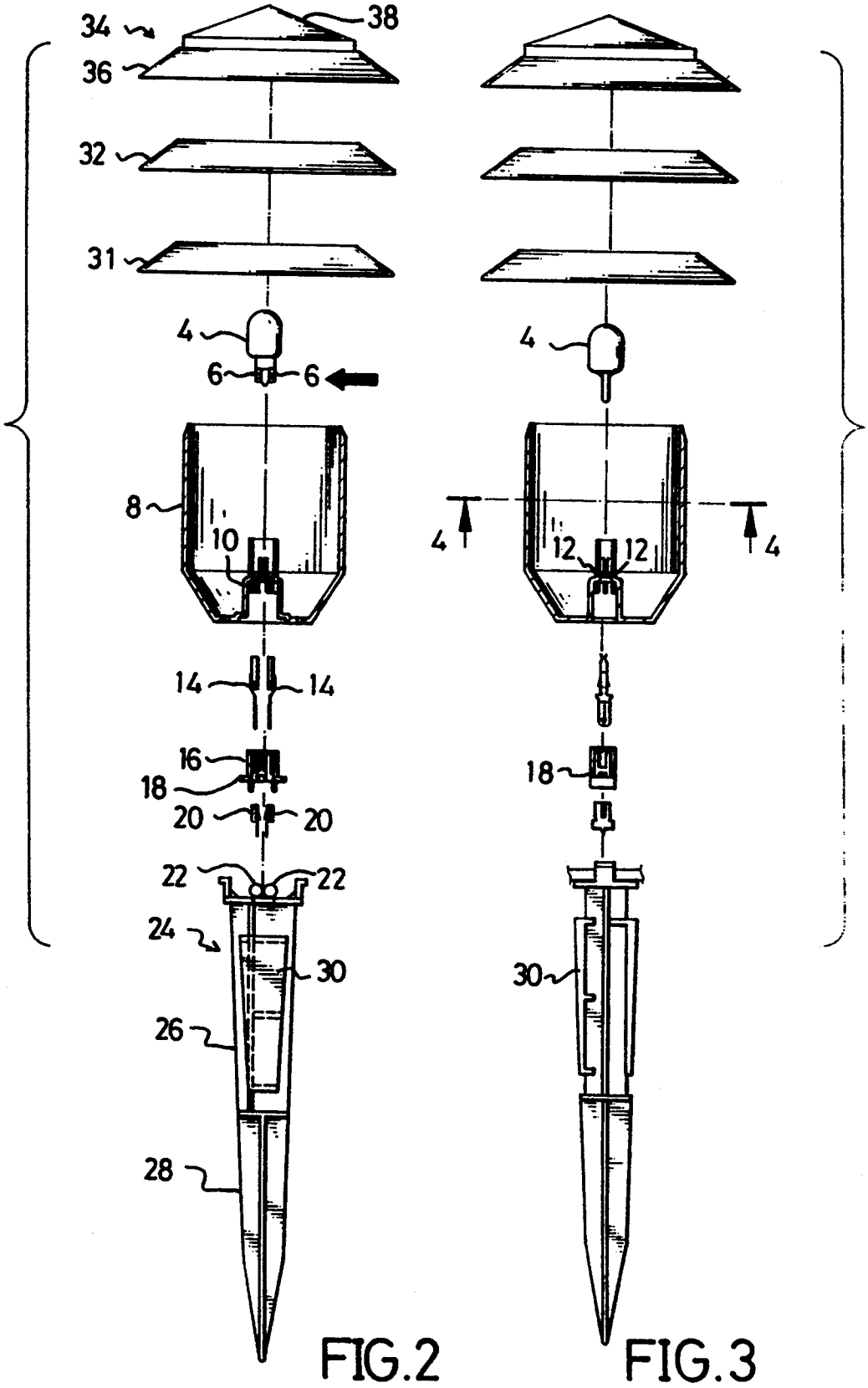
FIG. 2 is an exploded view of the temple light fixture in accordance with the preferred embodiment of the present invention.
FIG. 3 is a view taken along an arrow shown in FIG. 2.

Referring to FIGS. 1-3, a temple light 2 has which includes a neck (not numbered) from which two bulb leads 6 project. A lens 8 has a cylindrical configuration with an opening formed in an upper end and a bottom formed at a lower end. The bulb 4 can be mounted in the lens 8 by means of the opening formed in the latter.

Figure 4:
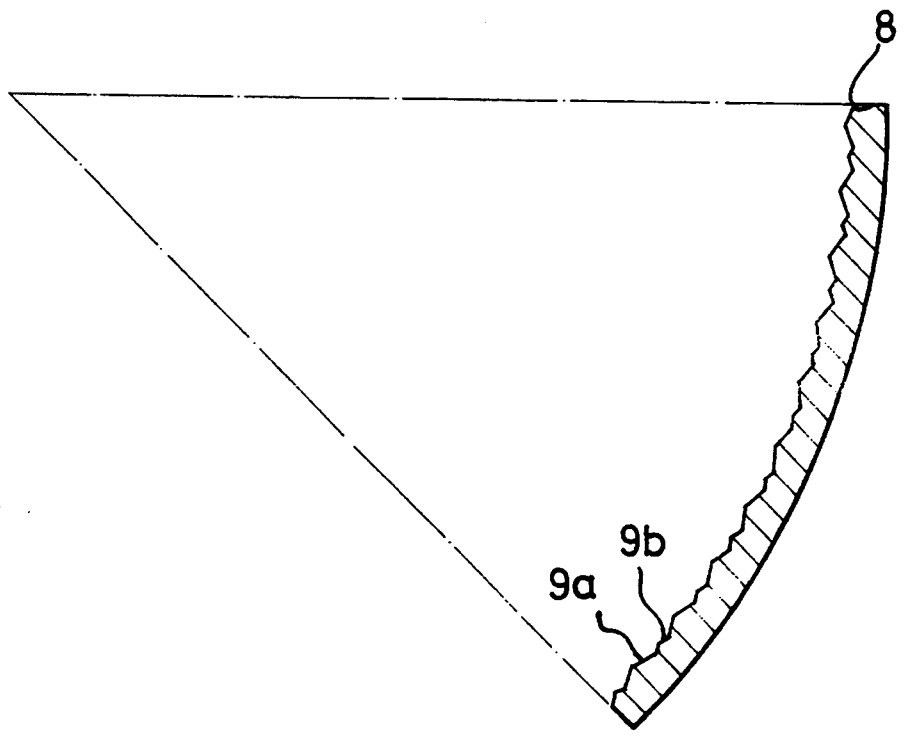
FIG. 4 is a cross-sectional view taken along a line 4—4 shown in FIG. 3.

Referring to FIG. 4, a number of large longitudinal ribs 9*a* and small longitudinal ribs 9*b* are alternatively formed on an internal side of the lens 8 in order to scatter light emitted from the bulb 4.

A bulb receiver 10 is integrally formed on the upper-side of the bottom of the lens 8. The bulb receiver 10 has an upper section and a lower section, the former has a smaller diameter than the latter does. The upper section of the bulb receiver 10 is used to contain the bulb 4. The upper section of the bulb receiver 10 forms two chambers each for receiving a corresponding bulb lead 6. The bulb receiver 10 has an appropriate length in order to retain the bulb 4 in an appropriate position therein. Two limits 12 are formed in each chamber defined in the bulb receiver 10. The neck of the bulb 4 is inserted into the bulb receiver 10. The neck of the bulb 4 is abutted against the limits 12.

Two bulb lead contacts 14 each have an upper section and a lower section longitudinally projecting from the upper section. The upper section of each bulb lead contact 14 has two opposite spring leaves each of which has an upper tip being convex toward the other and a lower tip extending away from the other (see FIG. 3). The upper section of each bulb lead contact 14 is received in a corresponding chamber formed in the bulb receiver 10. The upper tips of the spring leaves of each bulb lead contact 14 act as two jaws in order to firmly hold a corresponding bulb lead 6. The lower tips of the spring leaves of each bulb lead contact 14 act as two spring stoppers in order to engage with the limits formed in a corresponding chamber formed in the bulb receiver 10. Thus, the bulb leads 6 are firmly received in the bulb lead contact 14 which is firmly received in the bulb receiver 10.

A connector 16 is made of plastic. Two chambers are formed in the connector. The connector 16 is received in the bulb receiver 10 so that the lower section of each bulb lead contact 14 is received in a corresponding chamber formed in the connector 16. A limit 18 is formed in each chamber formed in the connector 16. The limits 18 are abutted against the bottom of the lens 8 when the connector 16 is inserted into the lower section of the bulb receiver 10.

Two replaceable cable-piercing contacts 20 each have an upper section and a lower section longitudinally protruding downward from the upper section. The upper section of each replaceable cable-piercing contact 20 has a tubular form. The lower section of each bulb lead contact 14 is received in the upper section of a corresponding replaceable cable-piercing contact 20 when the upper section of each replaceable cable-piercing contact 20 is received in a corresponding chamber defined in the connector 16. A snapping tab projects from the upper section of each replaceable cable-piercing contact 20. The snapping tab formed on the upper section of each replaceable cable-piercing contact 20 engages with the limit formed in a corresponding chamber formed in the connector 16 when the upper section of each replaceable cable-piercing contact 20 is inserted in a corresponding chamber defined in the connector 16. The lower section of each replaceable cable-piercing contact 20 acts as a prong so as to pierce a sheath which encloses a corresponding one of two cables 22 so that the bulb 4 is connected in parallel to the cables 22.

The temple light 2 further has a post/stake element 24. The post/stake element 24 has an upper section and a lower section longitudinally projecting from the upper section thereof. The upper section of the post/-stake element 24 acts as a post 26 while the lower section of the post/stake element 24 acts as a stake 28. The tip of the post 26 is linked to the bottom of the lens 8. A protector 30 is formed on the post 26. The cables 22 are disposed between the post 26 and the protector 30 so that the cables 22 will not be interfered by means of any lawn mowers (not shown). The post 26 has an appropriate length in order to retain the lens 8 at an appropriate position above the ground. The stake 28 tapers to a sharp tip so that it can be easily inserted into the earth. In view of both high strength and light weight, the stake 28 has a cruciform configuration as shown in a bottom view.

Two louvers 31 and 32 are mounted on the lens 8 for aesthetic purposes. An integral louver/cover element 34 is mounted on the upper end of the lens 8. The louver/cover element 34 consists of a louver 36 and a cover 38. The louver 36 is used for aesthetic purposes.

Figure 5:
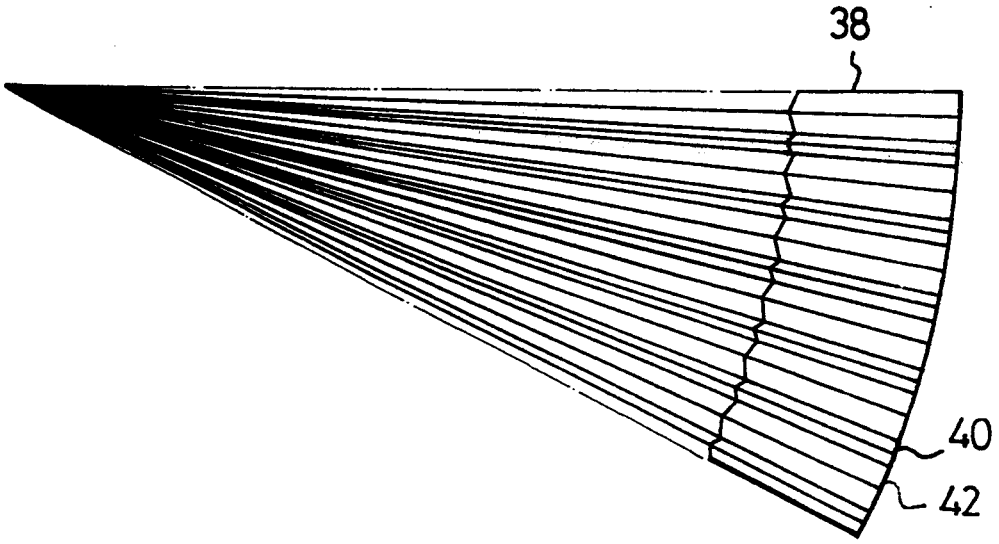
FIG. 5 is a bottom view of an upper louver used in the temple light fixture in accordance with the preferred embodiment of the present invention.

Referring to FIG. 5, a number of small radial ridges 40 and large radial ridges 42 are alternatively formed on the underside of the cover 38 in order to scatter light emitted from the bulb 4.

Figure 6:
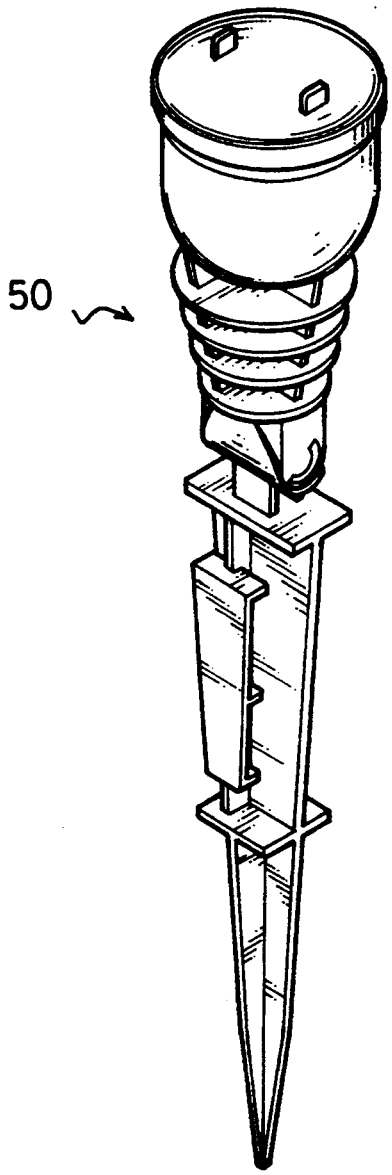
FIG. 6 is a perspective view of flood light fixture in accordance with the preferred embodiment of the present invention.
Figures 7, 8:
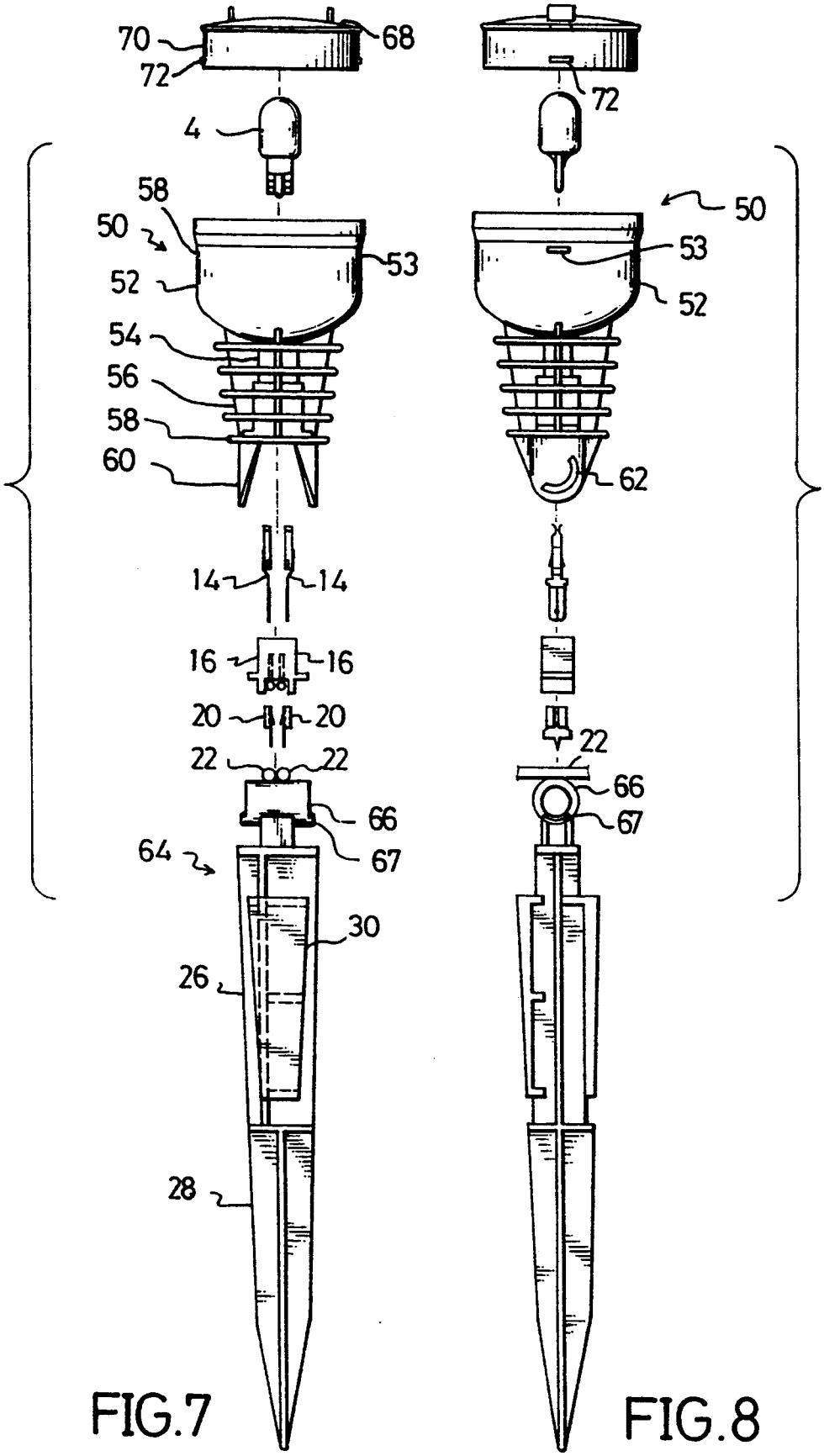
FIG. 7 is an exploded view of the flood light fixture in accordance with the preferred embodiment of the present invention.
FIG. 8 is a view taken along an arrow shown in FIG. 7.

Referring to FIGS. 6–8, a floodlight 50 uses a bulb 4 which is received in a housing 52 which has a bottom. The bottom of the housing 52 defines a smooth internal surface which can be covered by means of an appropriate coating for acting as a reflector. Thus, a separate reflector is eliminated.

Two opposite slots 53 are formed in the housing 52. A lens 68 has a tubular rim 70 formed thereabout. Two tabs 72 are formed on the tubular rim 70. Each tab 72 is received in a corresponding slot 53 formed in the housing 52 so as to firmly attach the lens 68 to the housing 52.

A bulb receiver 54 is integrally formed on the underside of the bottom of the housing 52. The bulb receiver 54 is identical to the bulb receiver 10, therefore, it will not be described in detail. Four blades 56 are formed on an underside of the housing 52 and are formed on the periphery of the bulb receiver 54 in order to reinforce the connection between the housing 52 and the bulb receiver 54. About the blades 56, several annular fins 58 are formed for radiation and decoration.

Two bulb lead contacts 14, a connector 16 and two replaceable cable-piercing contacts 20 are received in the bulb receiver 54 in a way identical to the way that they are received in the bulb receiver 10.

Two ears 60 project downward from the under end of the bulb receiver 54. An arc-shaped slot 62 is formed in each ear 60.

A post/stake element 64 has a post 26 and a stake 28. A joint 66 is transversely formed on the tip of the post 26. An arc-shaped slide 67 is formed on each of two ends of the joint 66. The depth of the slots 62 is identical to the thickness of the ears 60, i.e., each of the slots 62 is defined through one of the ears 60. Therefore, each of the arc-shaped slides 67 can be forced into one of the arc-shaped slots 62. The length of each slot 62 is greater than the length of each slide 67. Therefore, each of the arc-shaped slides 67 is slidable in one of the arc-shaped slots 62. Thus, the housing 52 is pivotally linked to the post/stake element 64.

I claim:

1. A temple light comprising:

a lens with a cylindrical configuration with an opening formed in a first end and a bottom formed at a lower end;

a bulb receiver projecting upward from the bottom of the lens;

a connector being mounted in the bulb receiver and defining two chambers;

two bulb lead contacts each comprising an upper section comprising two leaf springs and a lower section, the upper section of each bulb lead contacts being received in a corresponding chamber defined in the bulb receiver with the leaf springs holding a corresponding one of two bulb leads projecting from a bulb;

two replaceable cable-piercing contacts each comprising a tubular upper section and a sharp lower section, the lower section of a bulb lead contact being received in the tubular upper section of a corresponding cable-piercing contact being received in a corresponding chamber defined in the connector;

a post/stake element comprising a post and a stake projecting downward from the post, the post being linked to the bottom of the lens; and two cables inserted between the bottom of the lens and the post so that the sharp lower section of each of the cable piercing contacts is inserted into and engaged with one of the cables.

2. A flood light comprising:

a housing with a cylindrical configuration with an opening formed in a first end and a bottom formed at a second end, the bottom defining a smooth internal surface covered by means of a coating for acting as a reflector;

a bulb receiver projecting downward from the bottom of the light-reflecting housing;

two ears projecting downward from the bulb receiver and each defining an arc-shaped slot;

a connector being mounted in the bulb receiver and comprising two chambers;

two bulb lead contacts each comprising an upper section comprising two leaf springs and a lower section, the upper section of each bulb lead contact being received in a corresponding chamber defined in the bulb receiver with the leaf springs holding a corresponding one of two bulb leads projecting from a bulb;

two replaceable cable-piercing contacts each comprising a tubular upper section and a sharp lower section, the lower section of a bulb lead contact being received in the tubular upper section of a corresponding cable-piercing contact being received in a corresponding chamber defined in the connector;

a post/stake element comprising a post, a stake projecting downward from the post, a joint transversely formed on the tip of the post and two arc-shaped slides formed on two ends of the joint, each arc-shaped slide being received in a corresponding arc-shaped slot in order to pivotally link the housing to the post/stake element; and two cables inserted between the bottom of the lens and the post so that the sharp lower section of each of the cable piercing contacts is inserted into and engaged with one of the cables.

* * * * *